US005975008A

United States Patent [19]

Malta

[11] Patent Number: 5,975,008

[45] Date of Patent: Nov. 2, 1999

[54] ROTATABLE STRIKING ELEMENTS FOR A HANDBELL

[75] Inventor: Jacob H. Malta, New Britain, Pa.

[73] Assignee: Malmark, Inc., Plumsteadville, Pa.

[21] Appl. No.: 09/030,913

[22] Filed: Feb. 26, 1998

Related U.S. Application Data

[60] Provisional application No. 60/041,141, Mar. 17, 1997.

[51] Int. Cl.[6] ..... G10K 1/074; G10K 1/072

[52] U.S. Cl. ..... 116/171; 116/148; 116/155

[58] Field of Search ..... 116/171, 148, 116/149, 150, 152, 154, 155, 156, 158, 169, 172; 84/406, 402, 407

[56] References Cited

U.S. PATENT DOCUMENTS

| | | | |
|---|---|---|---|
| 3,253,574 | 5/1966 | Malta | 116/171 |
| 4,466,329 | 8/1984 | Hayward | 84/406 |
| 4,484,535 | 11/1984 | Hayward | 116/171 |
| 4,566,400 | 1/1986 | Keenan et al. | 116/171 |

*Primary Examiner*—Diego Gutierrez
*Assistant Examiner*—R A Smith
*Attorney, Agent, or Firm*—Gregory J. Gore

[57] ABSTRACT

A clapper assembly includes circular strikers which can be individually rotated so that a new portion of the surface of the striker is presented in the direction of the clapper stroke. A pair of opposing plates located at the end of the clapper bar retain circular, donut-shaped striking elements. Each striker is secured between the plates by a retaining screw through the axis of the striking element. By loosening the screws, the individual strikers may be rotated. Thus, when a portion of the striker becomes worn, it may be loosened and manually rotated to a new position so that a fresh unused area is presented. In addition, the entire clapper assembly may be rotated so that strikers of different compressibility can be interchanged.

11 Claims, 2 Drawing Sheets

ROTATABLE STRIKING ELEMENTS FOR A HANDBELL

Priority based upon Provisional Patent Application Ser. No. 60/041,141, filed on Mar. 17, 1997, entitled "Rotatable Striking Elements For A Handbell", is hereby claimed.

FIELD OF THE INVENTION

This invention relates to the clappers for musical handbells. More specifically, it relates to a clapper assembly with rotatable heads.

BACKGROUND OF THE INVENTION AND DESCRIPTION OF PRIOR ART

Musical handbells may be individually adjusted to produce different types of sounds by rotating the clapper head. Handbells with this type of clapper have a rotatable head which includes striking elements of different compressibility arranged around the periphery of a round head. By rotating a head to a different position, active striking elements are changed from one to another. As different elements are selected, the sound of the bell can be varied from a sharper sound, when the striking element is made of a hard, less compressible material, to a softer sound if the active striking element is softer, i.e., more compressible.

The problem with the prior art adjustable clapper assemblies is that the striking elements wear out quickly and need to be replaced. Because the individual elements have only a very small available surface area, the strikers need to be replaced frequently, especially in larger bells where the striking force is greater. This requires disassembly of the clapper head and installing a new striker element.

Patent references which illustrate this type of adjustable clapper assembly include U.S. Pat. No. 4,484,535 issued to Hayward; U.S. Pat. No. 4,566,400 issued to Keenan et al; and U.S. Pat. No. 3,253,574 issued to Malta. These references disclose rotatable clapper heads capable of presenting striking areas of different compressibility to produce different sound characteristics. However, there is no provision for utilizing different areas of one striking element of the same compressibility to extend wear so that replacement of the striker elements will not be required as frequently.

SUMMARY OF THE INVENTION

The present invention has been devised in order to minimize the replacement of worn out striker elements in an adjustable clapper assembly. The new clapper assembly includes circular strikers which can be individually rotated so that a new portion of the surface of the striker is presented in the direction of the clapper stroke. In this way, when a portion of the striker becomes worn, it may be manually rotated to a new position so that a fresh unused area is presented. When the new striking area becomes worn, the process is repeated until the entire surface area around the circumference of the striker is used.

The features of the invention described above are achieved in part by the use of a pair of opposing plates located at the end of the clapper bar. Circular, donut-shaped striking elements are affixed between these plates. Each striker is secured between the plates by a retaining screw which is located through its axis. As each screw is tightened, the strikers are axially compressed by the increased force between the plates. This force is adjusted so that the strikers are sufficiently secured against movement for playing the bell, but when pressure is manually applied to the circumference of the striker, it may be rotated. Thus, the securement of the strikers may be described as a rotatable friction fit. The clapper assembly of the present invention may be used on different types of bells, however, it is particularly advantageous for use with larger bells where the greater striking force can cause rapid wear of the surface of the striking element.

More specifically, the applicant has devised a handbell, comprising: a bell body and a handle affixed thereto to impart a swinging motion; a clapper rod located within the bell body hingeably connected to the handle; a clapper head affixed to the free end of the clapper rod for striking the inside of the bell body when the handbell is swung; a plurality of striker elements affixed to the clapper head, one of the strikers having a zone of impact along a smooth circular outer surface, each of the strikers being of uniform compressibility, but of different compressibility from each other; and means for independently rotating said one of the strikers about an axis at the center of the circular outer surface whereby the zone of impact can be moved to an unused portion of the striker element, changing its compressibility at impact.

Other objects, advantages and novel features of the invention will become apparent from the following detailed description of the invention when considered in conjunction with the accompanying drawings.

DESCRIPTION OF THE PREFERRED EMBODIMENT

Figure 1:
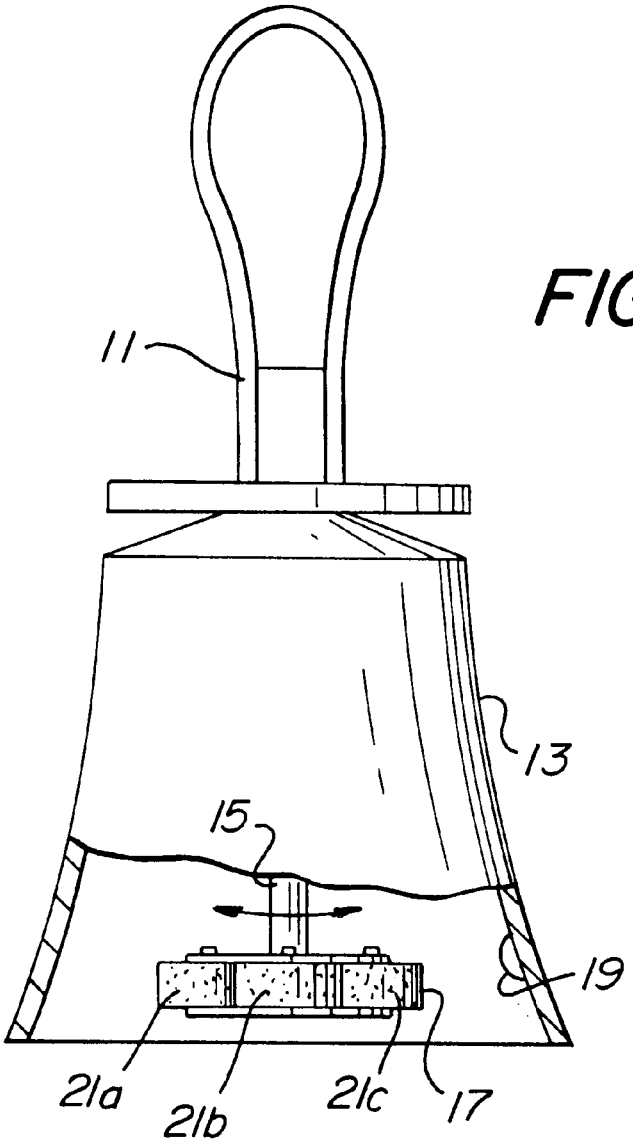
FIG. 1 is a front elevation partial cutaway view of a handbell utilizing the clapper assembly of the present invention.

FIG. 1 shows a handbell constructed according to the present invention which includes the previously described novel clapper head assembly. The handbell is swung by handle 11 causing a swinging clapper head assembly 17 supported by clapper rod 15 and hinge means not shown in this figure to strike the inside surface of the bell 13, producing a musical note. In this figure, a zone of impact, a surface area 17 of striker 21*a*, will contact the inside bell of the bell at approximately area 19. The clapper head assembly of the present invention includes a plurality of strikers 21*a, b* and *c*.

Figure 2:
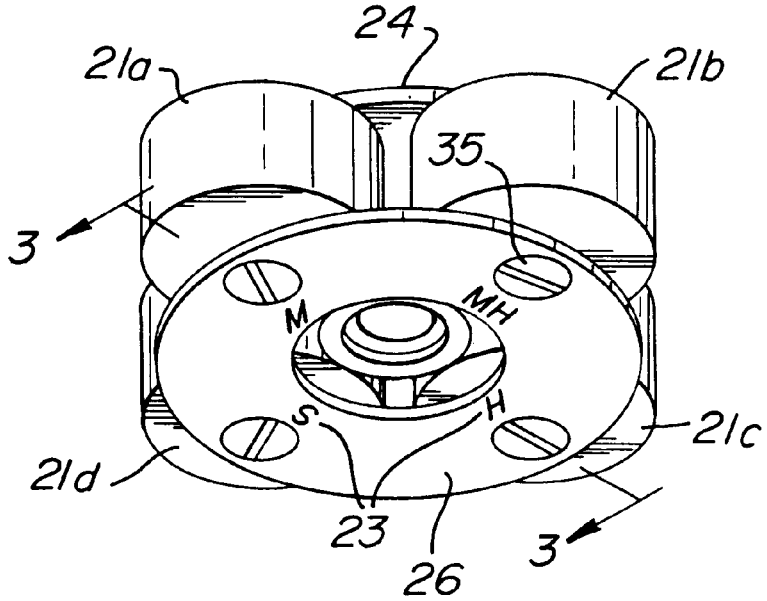
FIG. 2 is a bottom isometric view of the clapper head assembly.

Turning now to FIG. 2, the clapper head assembly is shown in isolation. The individual strikers 21*a b, c* and *d* are cylindrical having a circular cross-section. They are carried between two plates 24 and 26, each being individually secured thereto by screw means 35 in identical fashion. The material of the different striker elements varies in its compressibility. If the entire clapper head assembly is rotated with respect to the clapper bar 90-degrees, another striker element of different compressibility is moved to the operative position and thereby the sound character of the notes played may be changed. A sharp-sounding note is created by the hard striker element having the least compressibility. A softer-sounding note is created by a striker element having a greater degree of compressibility. In the embodiment shown, indicia 23 indicate to the handbell ringer the different degrees of hardness of the varying striking elements indicated by the initials S, M, MH, and H, representing the characteristics soft, medium, medium hard, and hard respectively.

Figure 3:
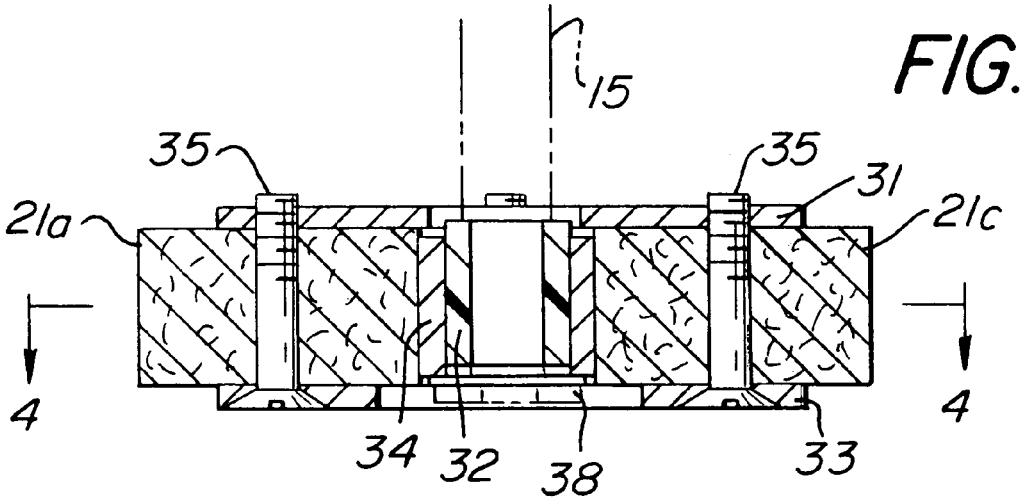
FIG. 3 is a sectional side elevation view taken from FIG. 2 as shown in that figure.

Referring now to FIG. 3, greater detail of construction of the present invention is shown. The clapper head assembly is affixed to an internally-threaded clapper bar 15 by way of screw means 38 which secures upper plate 33 rigidly thereto. Standoff sleeve 32 holds the assembly away from the end of the clapper bar. Around the standoff sleeve is fitted a cylindrical striker bumper 34. The individual strikers 21*a* and *c* are captured between the plates 33 and 31 which are fastened to the end of the clapper rod. Plate 33 is fastened to plate 31 by way of screw means 35 threaded into plate 31. As screws 35 are tightened, each of the strikers is ever greatly compressed between the plates.

Figure 4:
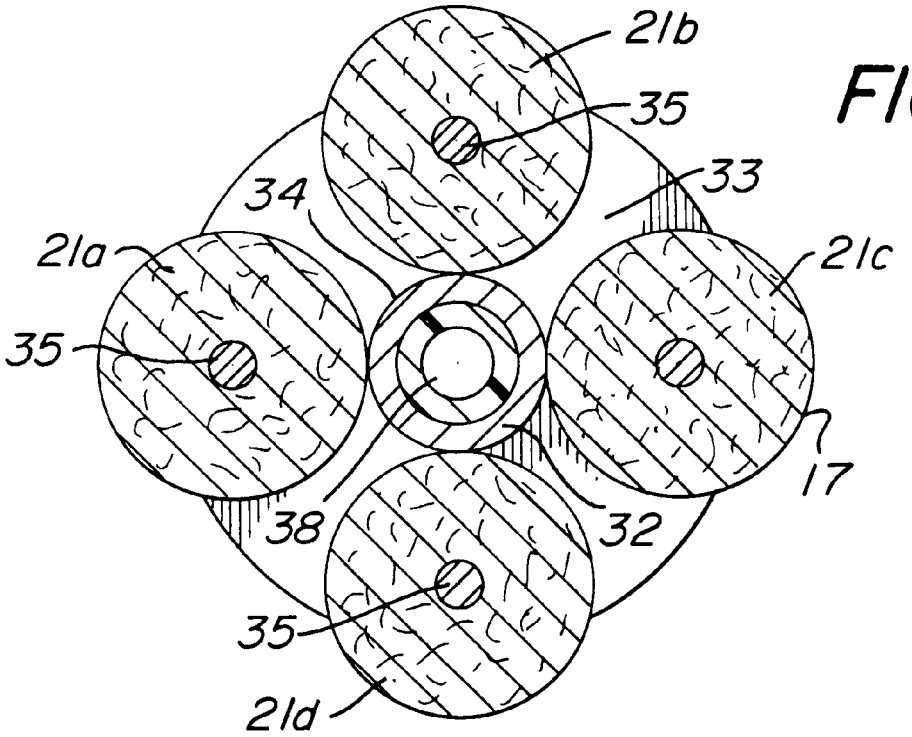
FIG. 4 is a sectional top plan view taken from FIG. 3 as shown in that figure.

Referring now to FIG. 4, a relative disposition of the striker elements 21*a, b, c*, and *d* is shown. Each is rotatably secured to plate 33 by way of screw means 35. Each striker element is held against rotation by the compressive forces between the plates. Bumper 34 provides striker support on the backside of each element (the side 180-degrees opposite from its impact zone) to reduce the lateral forces exerted on screw means 35 when the bell is struck. The bumper is held by bushing 32 which is secured to the clapper rod by screw 38. Screw means 35 are tightened so that each striker element material is pressed between the plates so that it is firmly held against rotation during normal playing, however, it is not so tightly held that each striker element may not be manually rotated by the bell ringer. This would be done from time to time when the striking surface of the element in the impact zone, for example surface area 17, becomes worn. In this way, a fresh surface area may then be presented as a new striking surface without the need for replacement of the element. By the mechanical relations described herein, this may be accomplished independently of other functions of the clapper head, namely, manually rotating the entire clapper head assembly to vary the sound.

It should be understood that the above description discloses specific embodiments of the present invention and are for purposes of illustration only. There may be other modifications and changes obvious to those of ordinary skill in the art that fall within the scope of the present invention which should be limited only by the following claims and their legal equivalents.

What is claimed is:

1. A handbell, comprising:

a bell affixed to a handle to impart a swinging motion;

a clapper rod located within said bell hingeably connected to said handle;

a clapper head affixed to a free end of said clapper rod for striking the inside of said bell when said handle is swung;

a plurality of striker elements affixed to said clapper head, at least two of said elements having a zone of impact along an outer surface, each of said elements being of uniform compressibility, but of different compressibility from each other; and means for independently rotating each of said striker elements about an axis whereby the zone of impact can be moved to another portion of said striker element without changing its compressibility at impact and, hence, the sound quality of the bell.

2. The handbell of claim 1, wherein said striker elements are positioned in a circular pattern, each having an axis of rotation which is equidistant from the clapper rod.

3. The handbell of claim 2, further including indicia on the bottom of the clapper head for indicating the relative compressibility of each strike element.

4. The handbell of claim 3, wherein said striker elements are rotatably held between opposing parallel plates affixed to the end of said clapper rod.

5. The handbell of claim 4, wherein said clapper head is selectively rotatable about said clapper rod such that one of said striker elements may be positionally interchanged with another of said striking elements.

6. The handbell of claim 5, wherein said clapper head is releasably affixed to the end of said clapper rod.

7. The handbell of claim 6, wherein said outer surface of said striker elements are circular and equidistant from said axis.

8. The handbell of claim 7, wherein said circular outer surface of said striker element is smooth.

9. The handbell of claim 8, further described in that there are four striker elements equally spaced about the circumference of said clapper head.

10. The handbell of claim 9, wherein all of said striker elements are of different compressibility.

11. The handbell of claim 7, wherein said striker elements are all of the same diameter.

* * * * *